US010799737B2

(12) United States Patent
Shipman

(10) Patent No.: US 10,799,737 B2
(45) **Date of Patent: *Oct. 13, 2020**

(54) FLEXIBLE DRY SPRINKLER

(71) Applicant: VICTAULIC COMPANY, Easton, PA (US)

(72) Inventor: Buddy Clayton Shipman, Heath, TX (US)

(73) Assignee: VICTAULIC COMPANY, Easton, PA (US)

( * ) Notice: Subject to any disclaimer, the term of this patent is extended or adjusted under 35 U.S.C. 154(b) by 486 days.

This patent is subject to a terminal disclaimer.

(21) Appl. No.: 15/151,847

(22) Filed: May 11, 2016

(65) Prior Publication Data

US 2016/0250507 A1 Sep. 1, 2016

Related U.S. Application Data

(63) Continuation of application No. 13/176,834, filed on Jul. 6, 2011, now Pat. No. 9,358,411.

(Continued)

(51) Int. Cl.
*A62C 35/62* (2006.01)
*A62C 35/64* (2006.01)

(Continued)

(52) U.S. Cl.
CPC ..... *A62C 35/62* (2013.01); *A62C 3/004* (2013.01); *A62C 35/645* (2013.01); *A62C 35/68* (2013.01);

(Continued)

(58) Field of Classification Search
CPC ..... A62C 3/004; A62C 35/62; A62C 35/645; A62C 35/68; A62C 37/11; A62C 37/12; A62C 37/14; A62C 37/46; A62C 37/48
See application file for complete search history.

(56) References Cited

U.S. PATENT DOCUMENTS 1,542,462 A 6/1925 Loepsinger
2,155,990 A 4/1939 Hodgman, Jr.

(Continued)

FOREIGN PATENT DOCUMENTS

CA 2765874 A1 3/2011
CN 2380254 Y 5/2000

(Continued)

OTHER PUBLICATIONS

Dec. 19, 2017 Search Report issued in Singapore Patent Application No. 10201601409U.

(Continued)

*Primary Examiner* — Darren W Gorman
(74) *Attorney, Agent, or Firm* — Oliff PLC

(57) ABSTRACT

A fire sprinkler head (12) has a valve (42) with an X-brace latch (54), and includes a flexible conduit (14). A sprinkler nozzle (16) is secured to a first end of the flexible conduit (14). The sprinkler nozzle (16) includes a first fitting (28), a sprinkler orifice (20) and fusible element (22). A second fitting (40) is secured to the second end of the flexible conduit (14) and includes the valve (42). The valve (42) has a valve element (44) which is moveable from a latched position to an unlatched position. A flexible link (56) extends from the sprinkler nozzle (16) to the X-brace valve latch (54). Breaking of the fusible element (22) releases the flexible link (56) to move from the latched position to the unlatched position, releasing the valve (42) for flow therethrough.

9 Claims, 4 Drawing Sheets

Related U.S. Application Data

(60) Provisional application No. 61/496,347, filed on Jun. 13, 2011, provisional application No. 61/490,737, filed on May 27, 2011.

(51) Int. Cl.

| | |
|---|---|
| ***A62C 35/68*** | (2006.01) |
| ***A62C 37/14*** | (2006.01) |
| ***A62C 3/00*** | (2006.01) |
| ***A62C 37/11*** | (2006.01) |
| ***A62C 37/12*** | (2006.01) |
| ***A62C 37/46*** | (2006.01) |
| *A62C 37/48* | (2006.01) |

(52) U.S. Cl.

CPC ..... *A62C 37/11* (2013.01); *A62C 37/12* (2013.01); *A62C 37/14* (2013.01); *A62C 37/46* (2013.01); *A62C 37/48* (2013.01)

(56) References Cited

U.S. PATENT DOCUMENTS

| | | | |
|---|---|---|---|
| 2,265,810 | A | 12/1941 | Lowe et al. |
| 2,871,953 | A | 2/1959 | Bray |
| 3,135,331 | A | 6/1964 | Lee |
| 3,309,028 | A | 3/1967 | Zieg et al. |
| 3,584,689 | A | 6/1971 | Willms |
| 3,616,860 | A | 11/1971 | Williams |
| 3,949,812 | A | 4/1976 | Hay |
| 4,177,862 | A | 12/1979 | Bray |
| 4,220,208 | A | 9/1980 | Jackson et al. |
| 4,305,469 | A | 12/1981 | Morrisette |
| 4,648,460 | A | 3/1987 | McCulloch |
| 5,188,184 | A | 2/1993 | Northill |
| 5,396,959 | A | 3/1995 | Macdonald |
| 5,415,239 | A | 5/1995 | Kotter et al. |
| 5,533,576 | A | 7/1996 | Mears |
| 5,570,745 | A | 11/1996 | MacDonald, III |
| 5,743,337 | A | 4/1998 | MacDonald, III |
| 5,775,431 | A | 7/1998 | Ondracek |
| 5,967,237 | A | 10/1999 | Sundholm |
| 5,967,240 | A | 10/1999 | Ondracek |
| 6,024,175 | A | 2/2000 | Moore, Jr. et al. |
| 6,105,678 | A | 8/2000 | Tsai |
| 6,119,784 | A | 9/2000 | MacDonald, III et al. |
| 6,158,519 | A | 12/2000 | Kretschmer |
| 6,286,604 | B1 | 9/2001 | Ou |
| 6,293,348 | B1 | 9/2001 | Reilly |
| 6,340,058 | B1 | 1/2002 | Dominick et al. |
| 6,484,513 | B1 | 11/2002 | Chou |
| 6,536,533 | B2 | 3/2003 | Reilly |
| 6,666,277 | B2 | 12/2003 | Reilly |
| 6,691,790 | B1 | 2/2004 | MacDonald, III et al. |
| 6,708,771 | B2 | 3/2004 | Reilly |
| 6,851,482 | B2 | 2/2005 | Dolan |
| 7,055,612 | B2 | 6/2006 | Jackson et al. |
| 7,185,711 | B2 | 3/2007 | Jackson et al. |
| 7,213,319 | B2 | 5/2007 | Silva, Jr. et al. |
| 7,373,720 | B1 | 5/2008 | Jensen et al. |
| 7,416,030 | B2 | 8/2008 | Lupien et al. |
| 7,516,800 | B1 | 4/2009 | Silva, Jr. et al. |
| 7,644,736 | B2 | 1/2010 | Bittenbender et al. |
| 7,766,252 | B2 | 8/2010 | Jackson et al. |
| 7,823,650 | B2 | 11/2010 | Eckholm et al. |
| 8,127,860 | B2 | 3/2012 | Golinveaux |
| 9,345,918 | B2 | 5/2016 | Bucher et al. |
| 2002/0003042 | A1 | 1/2002 | Reilly |
| 2002/0011342 | A1 | 1/2002 | Reilly |
| 2002/0050531 | A1 | 5/2002 | Dolan |
| 2002/0121381 | A1 | 9/2002 | Reilly |
| 2003/0075343 | A1 | 4/2003 | Ballard |
| 2004/0011537 | A1 | 1/2004 | Jackson et al. |
| 2004/0123989 | A1 | 7/2004 | Sprakel et al. |
| 2005/0121206 | A1 | 6/2005 | Dolan |
| 2009/0008104 | A1 | 1/2009 | MacDonald, III et al. |
| 2010/0038099 | A1 | 2/2010 | Thompson et al. |
| 2010/0263881 | A1 | 10/2010 | Fritz |
| 2011/0315407 | A1 | 12/2011 | Park et al. |
| 2012/0097406 | A1 | 4/2012 | Silcox et al. |
| 2012/0132444 | A1 | 5/2012 | Buzdum et al. |
| 2012/0298382 | A1 | 11/2012 | Shipman |
| 2012/0298383 | A1 | 11/2012 | Shipman |
| 2013/0199803 | A1 | 8/2013 | Muller |

FOREIGN PATENT DOCUMENTS

| | | | |
|---|---|---|---|
| CN | 101426585 | A | 5/2009 |
| CN | 201524372 | U | 7/2010 |
| CN | 102472418 | A | 5/2012 |
| DE | 39 19 638 | C1 | 11/1990 |
| DE | 202005011642 | U1 | 12/2005 |
| EP | 2 123 689 | A | 2/1984 |
| EP | 1 368 589 | A2 | 12/2003 |
| EP | 2 623 161 | A2 | 8/2013 |
| JP | 52-11998 | | 7/1975 |
| JP | 56-066355 | | 10/1979 |
| JP | 57-079555 | | 10/1980 |
| JP | 59-000155 | | 1/1984 |
| JP | 02-096161 | | 7/1990 |
| JP | H03-231684 | A | 10/1991 |
| JP | H06-170008 | A | 6/1994 |
| JP | 10-142251 | | 5/1998 |
| JP | H10-142251 | A | 5/1998 |
| JP | H1176449 | A | 3/1999 |
| JP | 2006-230645 | A | 9/2006 |
| JP | 2008-544808 | A | 12/2008 |
| KP | 10-1259098 | A | 5/2013 |
| KR | 10-2012-0098205 | B1 | 9/2012 |
| WO | 02/070071 | A2 | 9/2002 |
| WO | 2007/005286 | A2 | 1/2007 |
| WO | 2011/031722 | A1 | 3/2011 |
| WO | 2012/166636 | A1 | 12/2012 |
| WO | 2012/166644 | A1 | 12/2012 |

OTHER PUBLICATIONS

Dec. 26, 2017 Office Action issued in Chinese Patent Application No. 201380073463.4.

Aug. 5, 2016 Office Action issued in European Patent Application No. 13 745 781.8.

Jun. 30, 2016 Office Action issued in Canadian Patent Application No. 2,895,673.

Nov. 15, 2016 Office Action issued in Japanese Patent Application No. 2014-512157.

Apr. 5, 2016 Office Action issued in Japanese Patent Application No. 2014-512157.

Jan. 20, 2017 Office Action issued in U.S. Appl. No. 15/134,753.

Apr. 2017 Office Action with Search Report issued in Chinese Patent Application No. 201380073463.4.

Aug. 3 , 2017 Office Action issued in U.S. Appl. No. 15/134,753.

Aug. 8, 2017 Office Action issued in European Patent Application No. 13745781.8.

Aug. 2, 2017 Office Action issued in Chinese Patent Application No. 201280037396.6.

Apr. 22, 2015 Extended European Search Report issued in European Patent Application No. 12792109.6.

May 6, 2015 Office Action issued in Chinese Patent Application No. 201280037396.6.

Jul. 2, 2015 International Preliminary Report on Patentability issued in Application No. PCT/US2013/052835.

Sep. 29, 2014 Office Action issued in U.S. Appl. No. 13/176,834.

Jul. 16, 2015 Office Action issued in U.S. Appl. No. 13/176,834.

Nov. 30, 2015 Office Action issued in U.S. Appl. No. 13/722,571.

Aug. 7, 2014 Search Report issued in PCT Application No. PCT/US2013/052835.

Mar. 18, 2014 Office Action issued in U.S. Appl. No. 13/176,834.

Mar. 21, 2014 Office Action issued in U.S. Appl. No. 13/480,786.

Dec. 14, 2017 Office Action issued in Korean Patent Application No. 10-2013-7034115.

(56) References Cited

OTHER PUBLICATIONS

Dec. 14, 2017 Office Action issued in Korean Patent Application No. 10-2013-7034121.
Jun. 25, 2018 Office Action issued in Chinese Patent Application No. 201380073463.4.
Jul. 31, 2018 Office Action issued in Korean Patent Application No. 10-2017-7022996.
Sep. 19, 2018 Office Action issued in Chinese Patent Application No. 201280037396.6.
May 14, 2018 Office Action issued in U.S. Appl. No. 15/054,645.
May 3, 2018 Office Action issued in European Patent Application No. 13 745 781.8.
May 15, 2018 Office Action issued in Canadian Patent Application No. 2,837,318.
May 10, 2018 Office Action issued in Canadian Patent Application No. 2,837,316.
Oct. 31, 2018 Office Action issued in Korean Patent Application No. 10-2013-7034121.
Dec. 14, 2018 Office Action issued in U.S. Appl. No. 15/054,645.
May 13, 2019 Office Action issued in European Patent Application No. 12 793 586.4.
May 13, 2019 Office Action issued in European Patent Application No. 12 792 109.6.
Apr. 8, 2019 Office Action issued in Indian Patent Application No. 3797/CHENP/2015.
Mar. 28, 2019 Written Opinion issued in Singapore Patent Application No. 10201601409U.
Apr. 5, 2019 Office Action issued in Indian Patent Application No. 10247/CHENP/2013.
Mar. 27, 2019 Office Action issued in Chinese Patent Application No. 201280037396.6.
Mar. 8, 2019 Office Action issued in Korean Patent Application No. 10-2013-7034121.
Mar. 5, 2019 Office Action issued in Canadian Patent Application No. 2,837,318.
Mar. 5, 2019 Office Action issued in Indian Patent Application No. 10252/CHENP/2013.

12
14
16
18
20
22
24
26
28
30
32
34
36
38
40
42
44
46
48
50
52
54
56
58
60
62
64
66
68
70
72
74
76
78
80
82
84
86
88
90
92

FLEXIBLE DRY SPRINKLER

This is a continuation of application Ser. No. 13/176,834 filed Jul. 6, 2011, which claims priority to U.S. Provisional Patent Application Ser. No. 61/496,347, filed Jun. 13, 2011 and entitled "Sprinkler Hose Assembly," and U.S. Provisional Patent Application Ser. No. 61/490,737, filed May 27, 2011 and entitled "Corrosion Resistant Straight or Flexible Dry Fire Sprinkler Tube with X-Brace." The disclosures of those applications are incorporated by reference herein in their entirety.

BACKGROUND

The present invention relates in general to fire sprinkler systems, and in particular to fire sprinkler heads used for sprinkler systems.

Prior art conventional dry barrel sprinklers for use in commercial fire sprinkler systems are sold to fire system installers in fixed lengths. The installer has to first install branch line piping for a sprinkler system and then measure a suitable length for dry barrel fire sprinklers for installation. An installer will order fire sprinklers for the installation according to the lengths measured. Delivery typically takes seven to ten business days, which delays installation and completion of construction projects. Longer delays occur if mistakes are made in measuring and the fire sprinklers have to be reordered in a different length.

Dry fire sprinkler systems often deteriorate rapidly due to condensation being trapped in such systems. With rigid dry sprinkler systems, an increased number of fittings is often required to route rigid piping from a branch line to a desired fire sprinkler head location. This increase in the number of fittings results in providing additional places where condensation may collect without being able to drain. Additionally, dry fire sprinkler systems are filled with air or inert gas which is expelled during operation of such sprinkler systems. The response time for expelling air from the system and providing water to a fire zone is critical for containing a fire. With additional piping and fittings required for routing dry fire sprinkler systems, the volume required for evacuation and filling with water is increased.

SUMMARY OF THE INVENTION

A novel X-brace valve and flexible connection for fire sprinklers are disclosed. The X-brace is preferably included in a flexible fire sprinkler head, but may also be used in rigid sprinkler installations. The flexible fire sprinkler head is preferably a pendent dry fire sprinkler head, which has a flexible body structure, constructed of corrugated or braided hose similar to that commonly used for plumbing household clothes washing machines. A sprinkler nozzle secured to a first end of the conduit, which is preferably provided by a flexible hose. The sprinkler nozzle has a first fitting, a sprinkler orifice and fusible element. The fusible element is preferably provided by a fluid filled glass bulb which will break when ambient temperatures reach a predetermined temperature. A second fitting is secured to a second end of the flexible conduit, and a valve is mounted to the second fitting. The valve includes a valve element which is pivotally mounted to the second fitting and moveable from a latched position to an unlatched position. A flexible link extends from the sprinkler nozzle to the valve latch. Breaking of the fusible element releases the flexible link to move from the latched position to the unlatched position, releasing the valve to open for passing flow there-through. The flexible link provides a spring biased plunger having a plug which fits in the sprinkler orifice to seal against fluid flow there-through. Tension from the spring pulls the rod, or plunger, from within an X-brace valve latch which releases the valve element to open and pass water through the valve.

BRIEF DESCRIPTION OF THE DRAWINGS

For a more complete understanding of the present invention and the advantages thereof, reference is now made to the following description taken in conjunction with the accompanying Drawings in which

FIG. 1 is a side elevation view and partial cut-away view of a dry flexible fire sprinkler head made according to the present invention;

FIG. 2 is sectional view of the flexible fire sprinkler head of FIG. 1, taken along section line 2-2 of FIG. 1, and shows a frontal elevation view of an X-brace valve latch in an unlatched position;

FIG. 3 is a side elevation view of slider lock of the X-brace latch of FIG. 2, and shows the slider lock in a released position;

FIG. 4 is sectional view of the flexible fire sprinkler head of FIG. 1, taken along section line 2-2 of FIG. 1, and shows frontal elevation view of the X-brace valve latch in a latched position;

FIG. 5 is a side elevation view of a slider lock of the X-brace latch of FIG. 4, and shows the slider lock in a latched position;

FIG. 6 is an exploded view of the slider lock of FIG. 5; and

FIG. 7 is a side elevation view of an alternative lock pin.

DETAILED DESCRIPTION OF EMBODIMENTS

Figure 1:
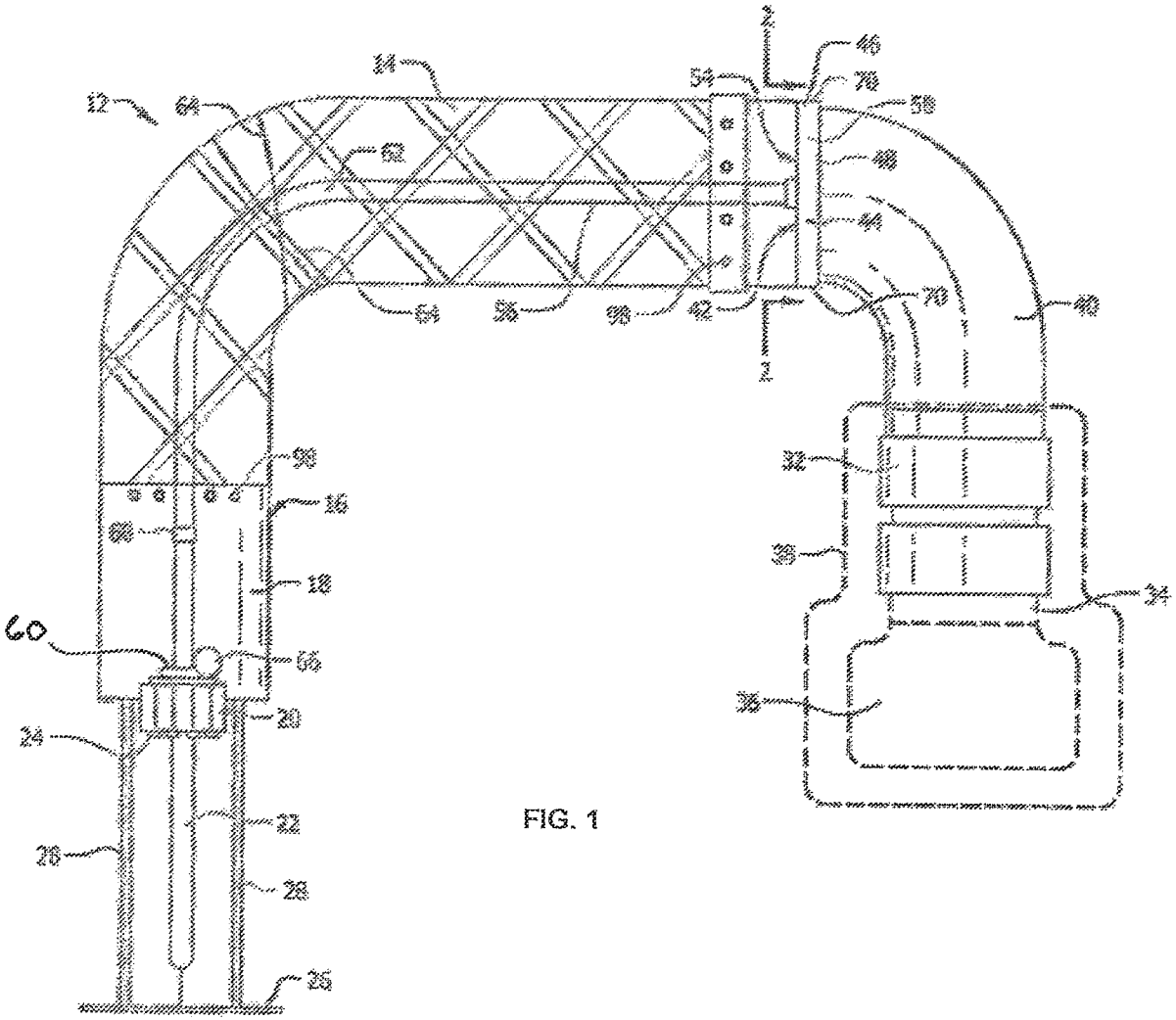
FIGS. 1 through 7 show various aspects for x-brace valve and flexible connection for fire sprinklers devices made according to the present invention, as set forth below.

Referring to the Figures, FIG. 1 is a side elevation view and partial cut-away view of a dry flexible fire sprinkler head 12 made according to the present invention. The sprinkler head 12 has a conduit 14, which is provided a flexible conduit such as that formed with an outer cover of braided metal. A sprinkler nozzle 16 is mounted to a first end of the flexible conduit 14 and a connector fitting 32 is mounted to a second end of the conduit 14. The sprinkler nozzle 16 preferably includes a fitting 18, a sprinkler orifice, and a fusible element 22, such as a fluid filled glass bulb as is conventionally used in other fire sprinkler heads. The fusible element 22 breaks when exposed to a predetermined temperature. A diffuser 26, or spray plate, and support arms 28 are also provided. The connector fitting 32 is preferably secured to the second end of the flexible conduit 14 with an elbow fitting 40 there-between. The connector fitting 32 preferably connects the sprinkler head 12 to a pipe T 34 in a sprinkler branch line 36. A connector coupling 38 secures the fitting 32 to the pipe T 34. A valve 42 is preferably provided between the fitting 32 and the flexible conduit 14. The valve 42 is preferably a swing check valve, such as a clapper valve, and includes a swing-type valve element 44, or clapper, mounted by means of a pivot 46 for angularly moving to engage a seal 48 against a seal seat 50. An X-brace valve latch 54 is provided for securing the valve element 44 in a latched position until the sprinkler head 12 is opened for flow by means of the fusible element 22 breaking in response to exposure to high temperatures.

A flexible link 56 extends from the valve latch 54 to the sprinkler nozzle 16. A first end of the flexible link 56 has a link pin 58 for fitting into the valve latch 54 as described herein-below to secure the valve latch 54 in a latched position. A second end of the link pin 58 has a plug adapter 60 for securing the flexible link 56 to the sprinkler plug 24, such that removal of the sprinkler plug 24 due to breaking of the fusible element 22 will allow downward movement of the flexible link 56. An intermediate portion 62 of the flexible link 56 connects the plug adapter 60 to the link pin 58. Centralizer braces 64 are shown for centering the flexible link 56 within the flexible conduit 14, A bias member 66 is preferably provided by a torsion spring which is connected between the fitting 18 and the orifice 20 and the flexible link 56. A coupler 68 secures the flexible link 56 to a run-out end of the bias member 66, which is preferably provided by a torsion spring. The bias member 66 provides a motive force for moving the flexible link 56 to pull the link pin 58 from engaging within the valve latch 54. A portion of the fitting 40 adjacent the valve latch 54 preferably has an undercut 70. The undercut 70 may be provided by a circumferentially extending groove, or by apertures formed radially into a first end of the fitting 40 to extend along a circumference of the fitting 40, in an angularly spaced, diametrically opposed arrangement.

Figure 2:
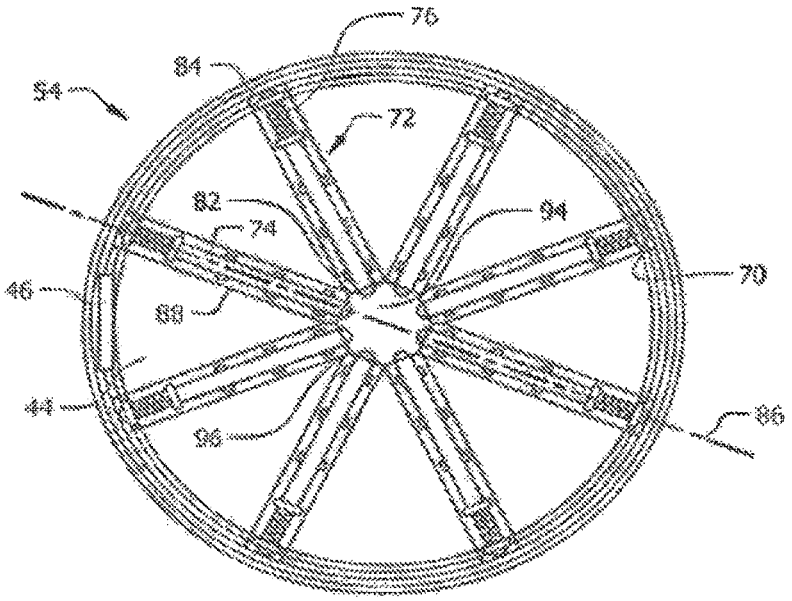
Figure 3:
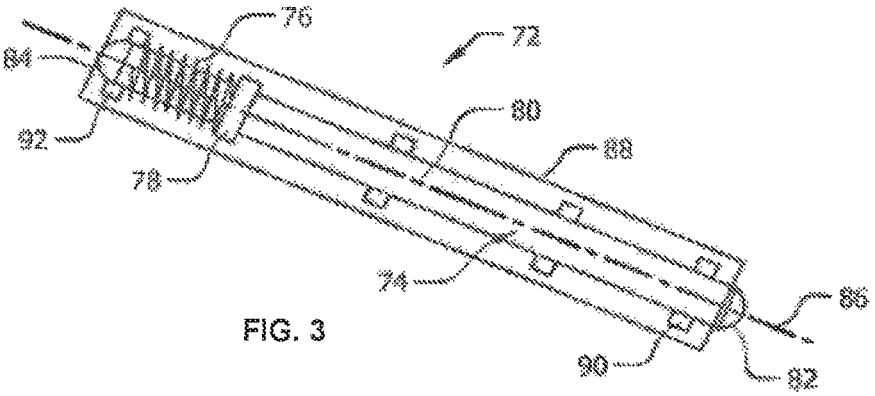

FIG. 2 is sectional view of the flexible sprinkler head 12 of FIG. 1, taken along section line 2-2 of FIG. 1, and shows a frontal elevation view of an X-brace type valve latch 54 in an unlatched position. FIG. 3 is a side elevation view of a slider lock 72 of FIG. 2, and shows the lock pin 74 in a released position. The valve latch 54 is shown having eight slider locks 72 arranged with respective longitudinal axes 86 in an angularly spaced alignment, with the longitudinal axes disposed equal angular distances about a central point of a brace eye 94. When the brace eye 94 is engaged by the flexible link 56, it is coaxial with a centrally disposed, longitudinal axis of the flexible link 56 and the link pin 58, The brace eye 94 defines a centrally disposed section of the valve latch 54, defined within a link pin guide 96 to which first ends of the brace arms 88 are fixedly secured. The slider locks 72 each preferably have a brace arm 88 and a lock pin 74. In some embodiments, the brace arms 88 may be integrally formed as part of the valve element 44. The lock pins 74 have an elongate stem 80, with a follower end 82 and a protuberant end 84. Preferably, the follower end 82 and the protuberant end 84 are of a round shapes. Space apart from the protuberant end 84 is a fixed shoulder 78. A bias member 76 is preferably provided by a wound coil spring for extending between the fixed shoulder 78 and a stop 92 provided on the brace arm 88, such that the lock pin 74 is urged to move away from the protuberance end 82 toward the follower end 82. The brace arms 88 further include retainers 90 for slidably securing the lock pins 74 to the brace arms 88 for reciprocating along respective ones of the longitudinal axes 86. When the link pin 58 is not disposed within the brace eye 94, the lock pins 74 are free to move toward follower ends 82 of respective ones of the slider locks 72 and the associated brace arms 88, such that follower ends 82 protrude into the brace eye 94.

Figure 4:
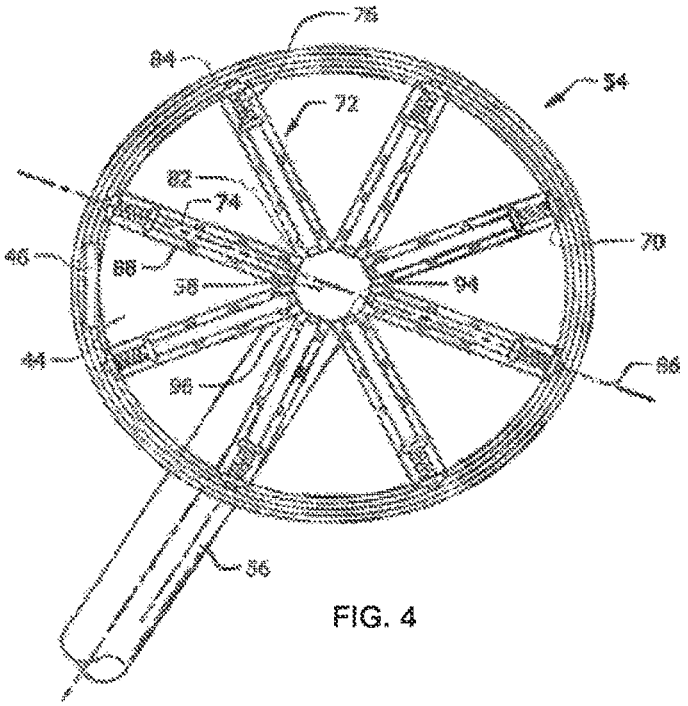
Figure 5:
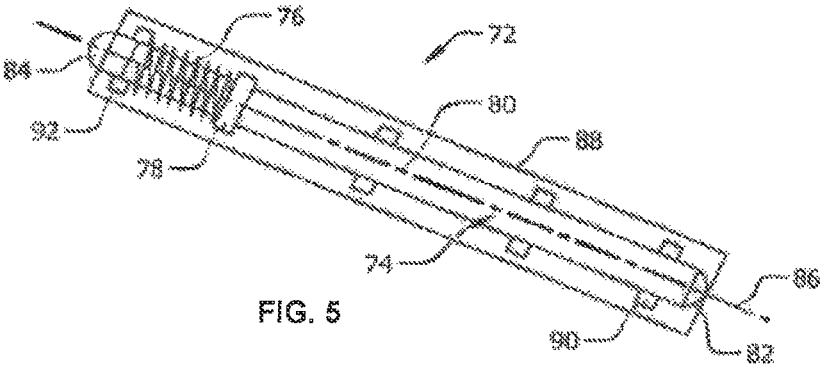
Figure 6:
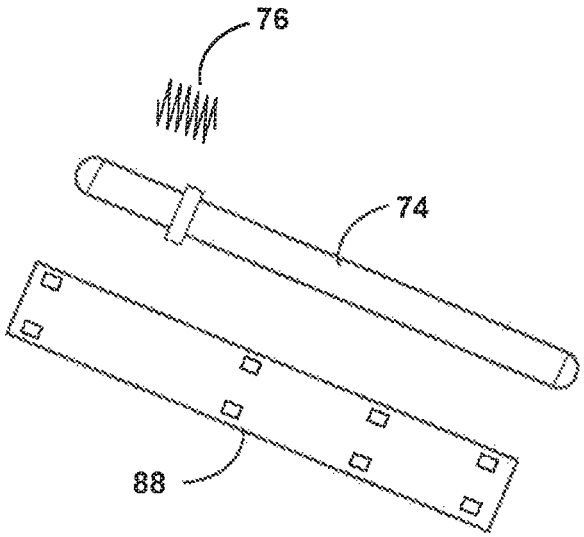

FIG. 4 is sectional view of the flexible sprinkler head 12 of FIG. 1, taken along section line 2-2 of FIG. 1, and shows frontal elevation view of the X-brace valve latch 54 in a latched position. FIG. 5 is a side elevation view and FIG. 6 is an exploded view of a brace arm 88 and lock pin 74 of the X-brace latch 54 of FIG. 4, and shows the lock pin 74 in the latched position. The flexible link 56 is shown in an initial position, as show in FIG. 1, with the link pin 58 engaged within the brace eye 94 of the valve latch 54. The link pin 58 being engaged within the brace eye 94 pushes the lock pins 74 of respective ones of the slider locks 72 radially outward from the brace eye 94, which moves the protuberant portions 84 to radially extend into the undercut 70 and secure the valve element 44 in a closed position. When the link pin 58 is removed from within the brace eye 94, the bias members 76 will urge the lock pins to move from latched positions, shown in FIGS. 4 and 5, into the released positions show in FIGS. 2 and 3, and the valve element 44 will open under the force of fluid pressure within the sprinkler branch line 36.

Figure 7:
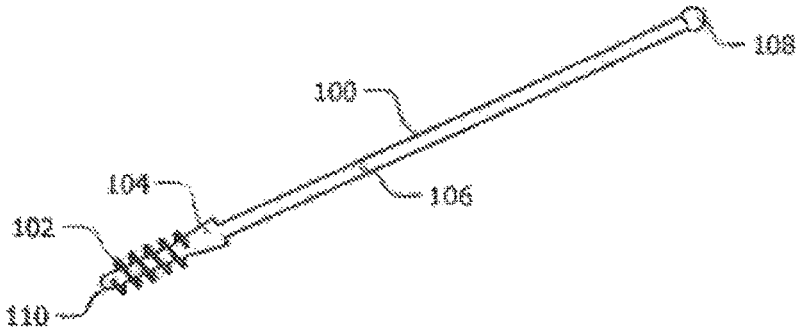

FIG. 7 is a side elevation view of an alternative lock pin 100. The lock pin 100 has a bias member 102 provided by a wound coil spring. The lock pin 100 preferably has an elongate stem 106, a follower end 108 and a protuberant end 110. The follower end 108 and the protuberant end 110 are preferably rounded ends. A fixed shoulder 104 is provided spaced apart from the protuberant end 110, for receiving the bias member 102 there-between.

Vent holes 98 are preferably provided in the fitting 18 and the elbow fitting 40, such that moisture will drain from within the flexible sprinkler head 12. In other embodiments, nitrogen or another inert gas may be sealed within the flexible sprinkler head 12 to prevent moisture from being retained within the sprinkler head 12, rather than providing the vent holes 98.

The X-brace valve element of the present invention may also be used in wet sprinkler installations, and in rigid sprinkler heads. For rigid sprinkler heads, flexible link 56 may be replaced by a rigid link such as a solid rod or a rigid tube, and the flexible conduit 14 replaced with a rigid tubular member, such as a pipe or tubing.

The present invention provides advantages of a flexible sprinkler head for use in dry fire sprinkler installations. An X-brace configuration locks a valve element in a latched position, until a fusible element breaks and then a bias member pulls a flexible link from within the X-brace configuration to release the valve element to open and allow water flow through the flexible sprinkler head.

Although the preferred embodiment has been described in detail, it should be understood that various changes, substitutions and alterations can be made therein without departing from the spirit and scope of the invention as defined by the appended claims.

What is claimed is:

1. A dry sprinkler head comprising:

a conduit having a first end and a second end, the conduit being configured to couple to a fluid supply;

a sprinkler nozzle mounted at the first end of the conduit; and a valve disposed proximate to the second end of the conduit and having an open state and a closed state, the valve configured to allow fluid from the fluid supply to flow through the conduit when the valve is in the open state and to prevent fluid from the fluid supply from flowing through the conduit when the valve is in the closed state; and a link that is flexible along its length and that extends between and is coupled to the sprinkler nozzle and the valve;

wherein the valve is moved from the closed state to the open state by movement of the link in the direction of the sprinkler nozzle when the sprinkler nozzle permits fluid to flow through the sprinkler nozzle.

2. The dry sprinkler head of claim 1, wherein the sprinkler nozzle includes an element that breaks when exposed to predetermined temperatures, such that breaking of the element causes the link to move the valve to the open state.

3. The dry sprinkler head of claim 2, wherein the link is located within the conduit.

4. The dry sprinkler head of claim 3, wherein the valve comprises a valve element that is moveable from a latched position to a released position, the valve element maintaining the valve in the closed state when the valve element is in the latched position and allowing the valve to be in the open position when the valve element is in the released position.

5. The dry sprinkler head of claim 4, further comprising a link pin that is attached to a first end of the link, the link pin interfaces with the valve element.

6. The dry sprinkler head of claim 5, wherein the link pin maintains the valve element in the latched position.

7. The dry sprinkler head of claim 6, wherein breaking of the element causes the link to move toward the sprinkler nozzle, which disengages the link pin from the valve element.

8. The dry sprinkler head of claim 1, further comprising a bias member that is connected to the link and that biases the link toward the sprinkler nozzle.

9. The dry sprinkler head of claim 2, further comprising a bias member that is connected to the link, wherein breaking of the element causes the bias member to pull on the link.

* * * * *